US005094040A

United States Patent [19]

Bunka

[11] Patent Number: 5,094,040

[45] Date of Patent: Mar. 10, 1992

[54] SKYLIGHT DRAINAGE APPARATUS AND METHOD

[76] Inventor: Terry M. Bunka, Box 102, Silverton, British Columbia, Canada, V0G 2B0

[21] Appl. No.: 592,352

[22] Filed: Oct. 2, 1990

[51] Int. Cl.[5] ..... E04D 13/03; E04D 13/04

[52] U.S. Cl. ..... 52/14; 52/22; 52/200

[58] Field of Search ..... 52/13, 14, 15, 200, 52/209, 126, 22

[56] References Cited

U.S. PATENT DOCUMENTS

| | | | |
|---|---|---|---|
| 3,983,669 | 10/1976 | Bogaert | 52/200 |
| 4,009,541 | 3/1977 | Yoneya | 52/14 |
| 4,194,325 | 3/1980 | Chalpin, Jr. | 52/14 |
| 4,776,141 | 10/1988 | Powell . | |

FOREIGN PATENT DOCUMENTS

| | | | |
|---|---|---|---|
| 1201264 | 3/1986 | Canada . | |
| 1247598 | 8/1967 | Fed. Rep. of Germany | 52/14 |
| 54-109222 | 8/1979 | Japan . | |

*Primary Examiner*—Richard E. Chilcot, Jr.
*Assistant Examiner*—Kien T. Nguyen
*Attorney, Agent, or Firm*—Barrigar and Oyen

[57] ABSTRACT

A skylight comprises a window frame, a support frame supporting the window frame, a flange fixed to and extending outwardly around the base of the frame, a flange trough formed in and circumscribing the flange, at least one outlet in the flange trough, and a collector trough for roof-embedded positioning beneath the flange trough outlet, the collector trough having a roof-penetrating outlet.

6 Claims, 3 Drawing Sheets

SKYLIGHT DRAINAGE APPARATUS AND METHOD

FIELD OF THE INVENTION

This invention relates to the field of gutters, and more particularly, gutters for use in skylight drainage systems.

BACKGROUND OF THE INVENTION

Roof mounted skylights in the prior art suffer from the drawback that if they are not painstakingly installed, run-off water from the skylight will leak between the skylight and the roof, thereby causing water damage to the structure under the roof. Conventionally, skylights comprise a transparent or tranluscent window mounted in a frame. The skylight is mounted so as to close an aperture in the roof between the roof support trusses. The frame of the skylight follows the perimeter of the aperture in the roof. Flashing is placed around the frame to divert run-off water from the skylight onto the outer surface of the roof.

Some skylights at present available in the marketplace include built-in flashing as an integral part of the skylight frame. These skylights are referred to as "self-flashing" skylights. Self-flashing skylights also divert run-off water onto the outer suface of the roof.

Self-flashing skylights work very well on roofs having a thin cross-sectional thickness and a relatively flat outer surface. However, conventional self-flashing skylights are not well adapted for use on roofs having large cross-sectional thickness due to non-uniform outer surfaces such as concrete, slate or clay tile. Currently, the procedure to mount a skylight in this type of roofing requires the penetration of the roof and the construction of a wood "curb" in the resulting aperture. The skylight is then mounted on the curb.

Constructing a curb adds to the expense. But without the curb, difficulty is encountered in draining the water away properly to the roof surface, in the case of thick roofs.

The present applicant avoids the foregoing problems by providing a self-flashing skylight structure that drains, at least in the vicinity of the skylight, internally rather than externally, relative to the outer surface of the roof.

U.S. Pat. No. 4,194,325, Chalpin Jr., issued 25 Mar., 1980, teaches collecting run-off water in secondary gutters 12, and passing the run-off water through drainage holes in the secondary gutters, into the primary gutters 10, which in turn direct the water to the perimeter gutter 16. The water is then conducted to appropriate conduits, or the like, for disposal thereof. Chalpin Jr. does not disclose roof-embedded gutters for conveying water beneath the roof structure.

U.S. Pat. No. 4,776,141, Powell, issued 11 Oct., 1988, provides ribs 17 on flange 16, said ribs forming channels to carry away from the opening for the skylight unit any water which may pass through the roofing material. The Powell patent does not, however, disclose the idea of carrying the water away from the skylight underneath the roof.

Japanese patent specification no. 109,222, Ishibashi, published 27 Aug., 1979, discloses a skylight having dew groove 3 which communicates with drain pipe 4. Drain pipe 4 drains water from groove 3 onto the outside of roof 6. Again, the idea of carrying water away from the skylight underneath the roof is not taught.

Canadian patent no. 1,201,264, Robertson, issued 4 Mar., 1986, teaches a system of channels for directing water away from a skylight. However, there is no disclosure of roof-embedded gutters for conveying water beneath the roof.

SUMMARY OF THE INVENTION

The present invention eliminates the requirement of constructing a curb when a self-flashing skylight is mounted in a roof having appreciable thickness. For this purpose, the skylight flashing is located under the roof surface, thereby allowing the use of self-flashing skylights without the need for separate wooden curbs in roofs having large cross-sectional thickness due to non-uniform outer surfaces. Run-off water is channeled along channels or troughs formed in the flashing flange and from thence into a roof-embedded channel or trough via an aperture in the first channel. Run-off water is then channelled through an opening in the roof-embedded channel or trough into a roof-penetrating drain pipe. The run-off water is then carried by the drain pipe, beneath the roof, out to the roof eaves.

In a preferred embodiment of the invention, a skylight comprises a window frame, a support frame supporting the window frame, a flange fixed to and extending outwardly around the base of the support frame, a flange trough formed adjacent and circumscribing the flange, at least one outlet in the lower portion of the flange trough, and a collector trough for roof-embedded positioning beneath the flange trough outlet, the second trough itself being provided with an outlet located underneath the outer surface of the roof.

DETAILED DESCRIPTION WITH REFERENCE TO THE DRAWINGS

Figure 1:
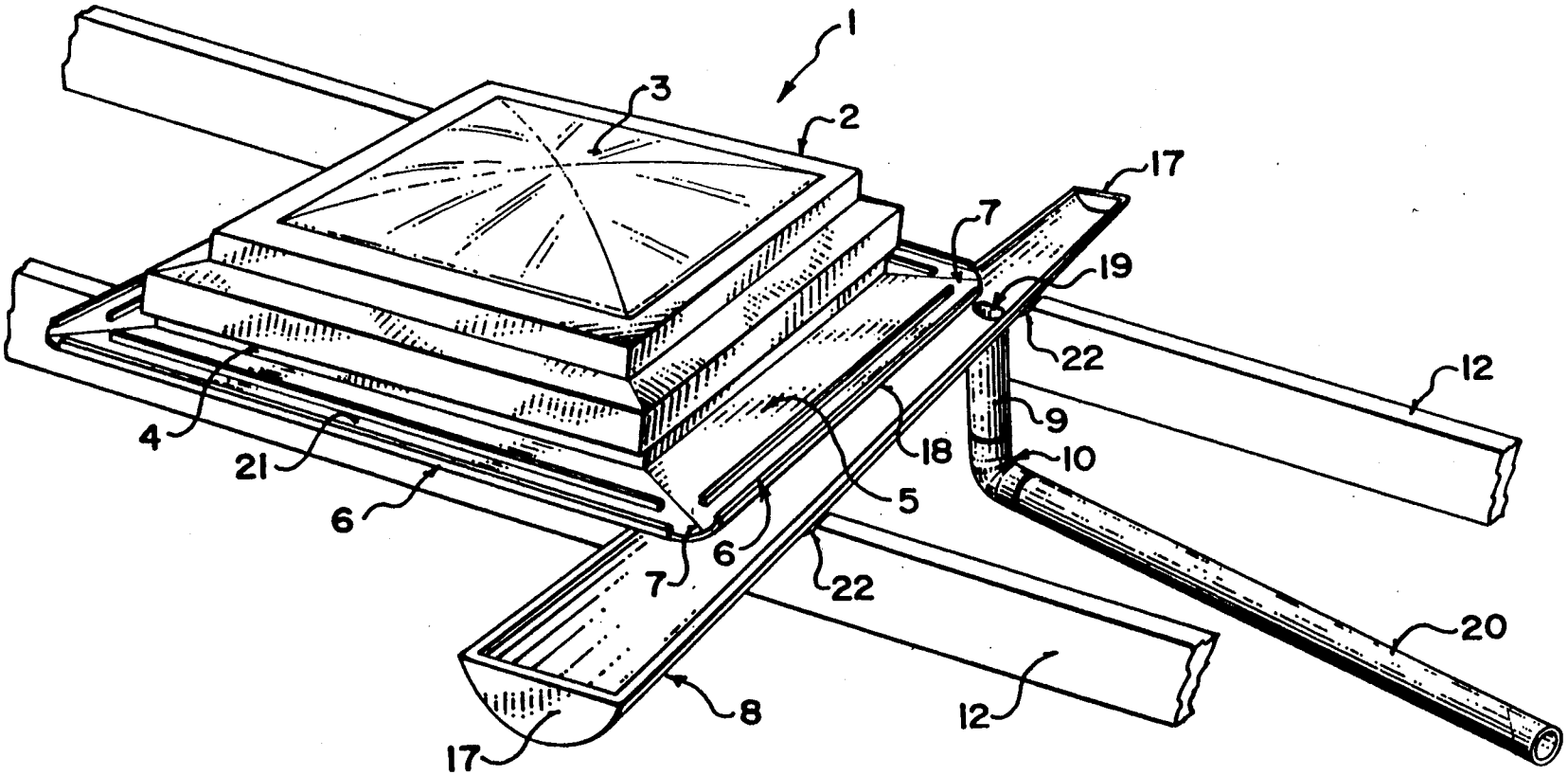
FIG. 1 is a partial cut-away perspective view of a skylight structure showing a gutter system embodying the teachings of the present invention.

Referring to FIG. 1, skylight 1 comprises a rectangular window frame 2 supporting a window 3. An adjoining stepped support frame 4 extends downwards from window frame 2. A flange 5 is affixed to and circumscribes the base of frame 4. A flange trough 6 formed integrally in and circumscribing flange 5 drains via corner outlets 7 formed at the extremeties of the lower edge 18 of trough 6. The collector trough 8 drains via drain aperture 19 leading into an outlet pipe 9. Outlet pipe 9 is elbowed at 10 and extends via extension 20 to any desired further drain, e.g. to an eavestrough (not shown) at the edge of the roof on which skylight 1 is mounted.

It is apparent from the foregoing description that run-off water is channeled by flange trough 6 into collector trough 8 via corner outlets 7. Collector trough 8 and outlets 7 do not of necessity have a fixed position relative to first trough 6, as long as run-off water from flange trough 6 will flow via at least one suitably located outlet into collector trough 8. Corner outlets are easily formed in flange 5 during manufacture, but outlets could be formed elsewhere along flange 5 if desired. It is of course necessary that collector trough 8 be positioned to catch the run-off water from outlets of the flange trough 6, wherever they may be located.

The skylight drainage system of the present invention is conveniently installed in stages. First, collector trough 8 is positioned in mating recesses 22 formed in roof trusses 12. Next, skylight 1 is mounted on roof trusses 12 over collector trough 8 so that outlets 7 are positioned to spill run-off water into collector trough 8, (making due allowance for arcuate spill of the water caused by kinetic energy of the water flow along side gutters 21 of flange trough 6). Outlet 9 is positioned and connected at drainhole 19 to collector trough 8 so as to draw run-off water from trough 8. Such further elbows and pipe extensions as may be needed are then provided so that outlet pipe 9 feeds into a suitable drain, e.g. the nearest eaves-trough. Finally, the outer roofing surface is applied in conventional manner so as to cover roof trusses 12 and abut frame 4 beneath window frame 2. A typical finished external result appears in FIG. 5, which shows a conventionally shingled outer roof surface 11. Note that flange 5 and trough 8 are underneath the roof shingling.

To the extent that any screwholes are present in flange 5, they present an unwanted opportunity for water to exit therefrom if not tightly sealed when the screws are tightened in place. To minimize the possibility that any appreciable amount of water might exit via the screwholes, the portion of flange 5 along which the line of screwholes is formed may be isolated by a barrier from the main channel of water flow along and over the flange.

Figure 2:
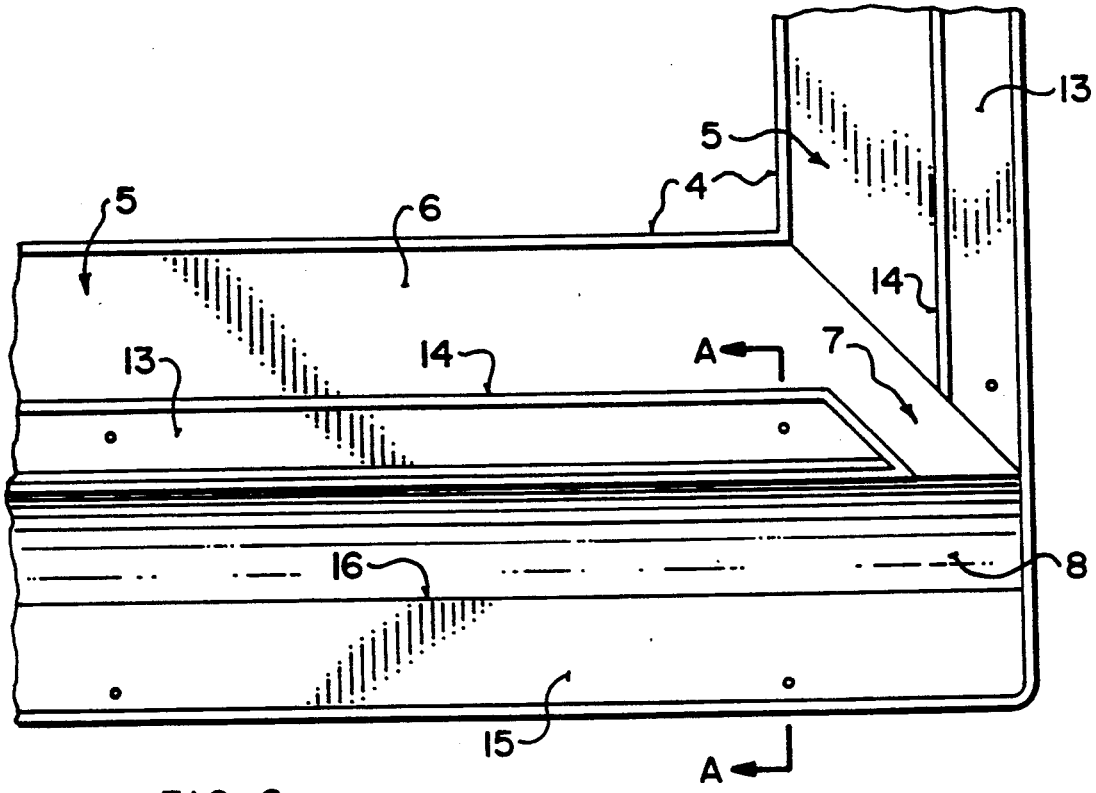
FIG. 2 is a partial plan view of a partial skylight structure showing a further embodiment of the present invention.
Figure 3:
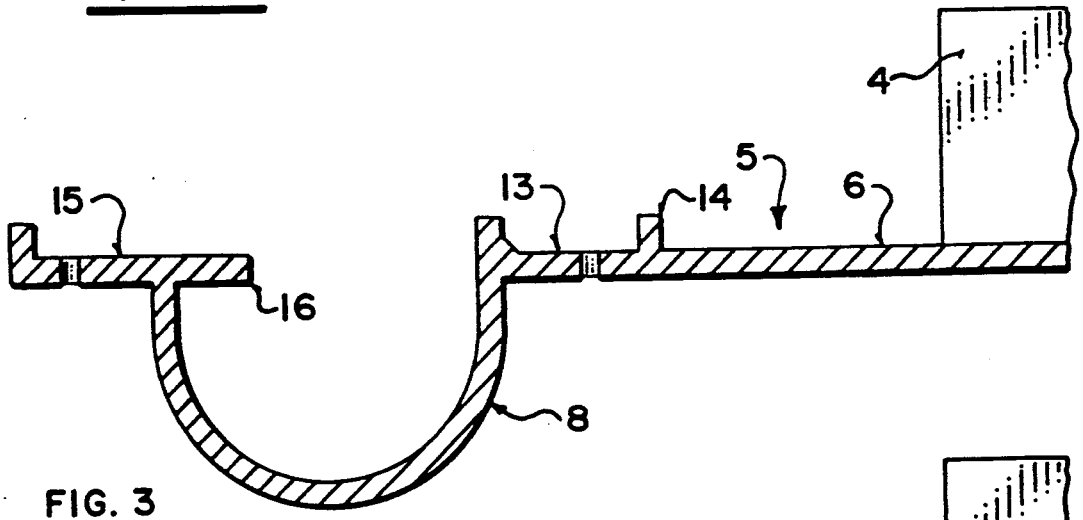
FIG. 3 is a section view along line A—A of the structure of FIG. 2.
Figure 4:
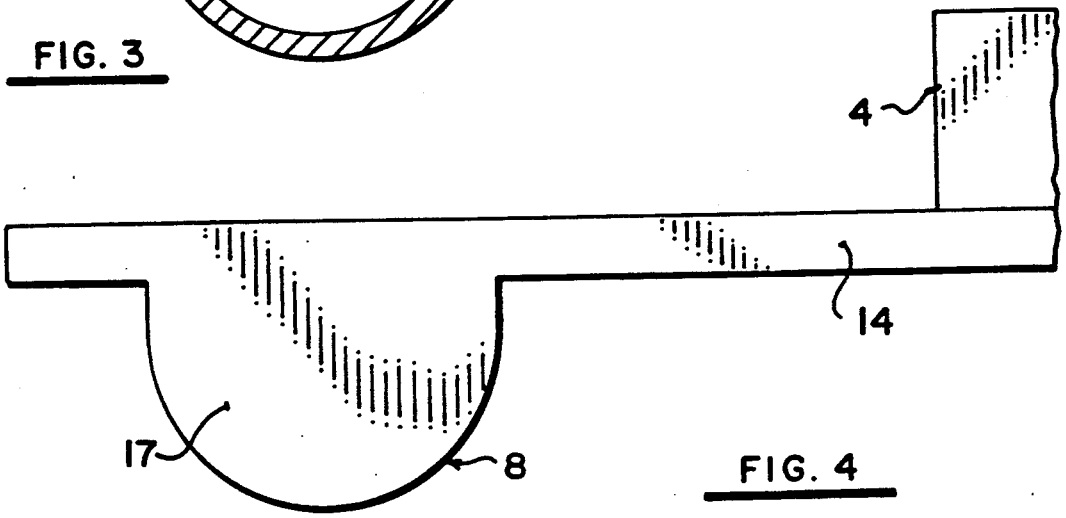
FIG. 4 is a partial side elevation view of the structure shown in FIG. 2.

To this end, FIGS. 2, 3 and 4 illustrate a further embodiment of the present invention.

As illustrated in FIG. 2, flange trough 6 is formed between frame 4 and screw channels 13 on flange 5. Screw channels 13, in which all screwholes in the flange 5 are formed, are isolated from flange trough 6 by means of barriers 14 extending parallel to and between the trough and screw channel portions of the flange 5 to prevent the incursion of water from flange trough 6 into the screw channels 13. Barriers 14 stop short of corner outlets 7 so as to permit water to drain freely away from flange 5 into collector trough 8.

As shown in FIG. 3, collector trough 8 is attached to and extends beneath the lowermost edge of flange 5. The upper edges of collector trough 8 are level with flange 5. The outer edge of collector trough 8 is formed as or fixed to an outer trough flange 15, for connection to a supporting cross-member (not shown). Trough flange 15 extends in the same plane as flange 5. A lip 16 formed adjacent or as an extension of trough flange 15 and projecting inwardly partially over collector trough 8, provides the base for a barrier of silicone sealant compound (not shown) for forming a seal between lip 16 and the underside of the roofing material against the possibility of water running on the underside of the roofing material and helps prevent overflow from collector trough 8 when skylight 1 is mounted on a steeply inclined roof.

As shown in FIG. 4, end surfaces 17 on collector trough 8 are flush with uppermost edges of barriers 14.

Figure 5:
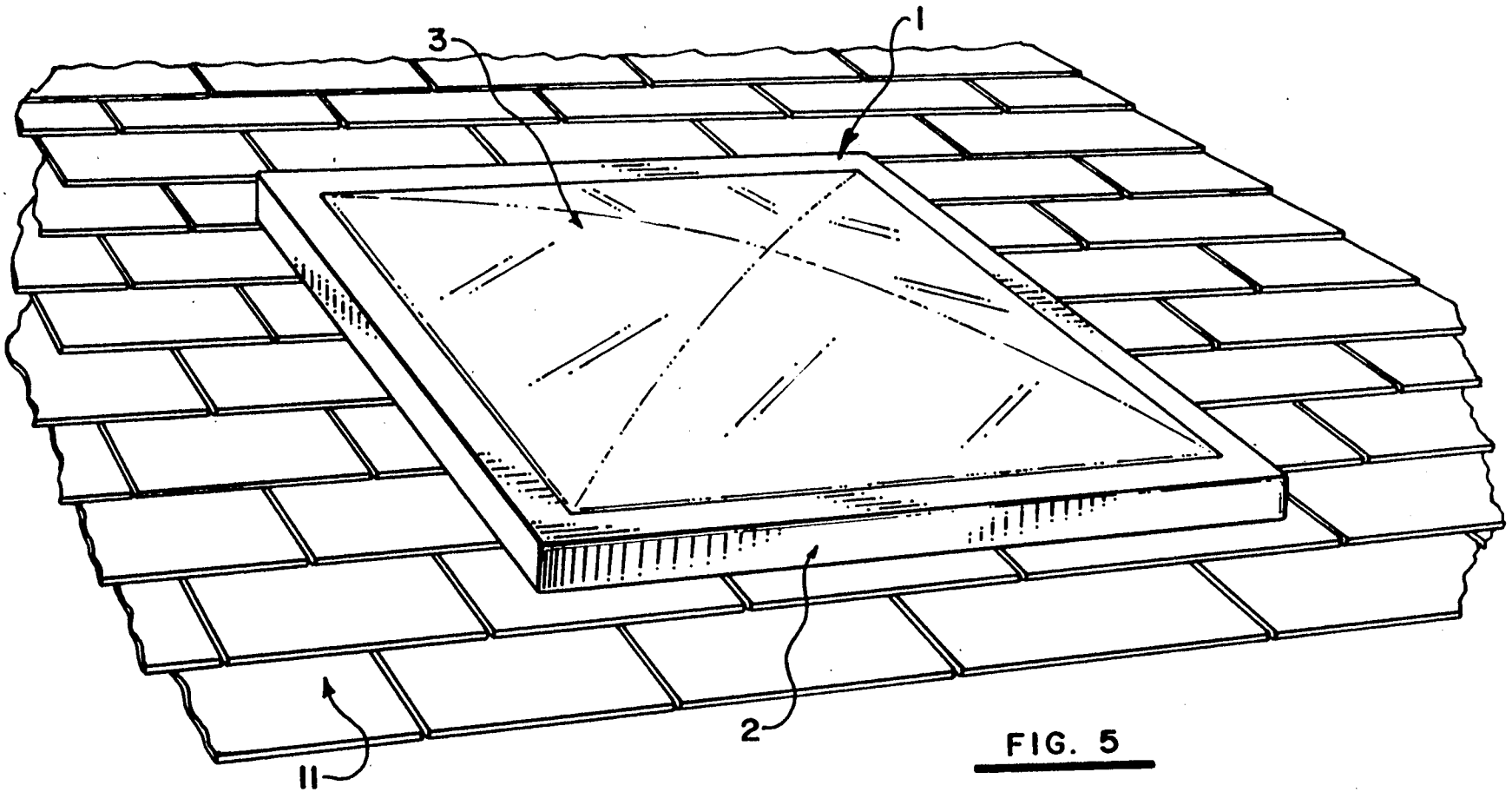
FIG. 5 is a perspective view of the external portion of a representative skylight having an internal structure conforming to the present invention.

FIG. 5 illustrates a representative exterior structure of an embodiment of the present invention incorporated into a finished roof. Only window 3 and window frame 2 protrude from the outer surface 11 of the roof. Frame 4 (not shown in FIG. 5; see e.g. FIG. 1) extends downwards from window frame 2, through the thickness of the roofing material which forms the outer layer 11 of the roof. Flange 5 then extends under the roofing material, between the roofing material and roof trusses 12 (see e.g. FIG. 1).

An important feature of both embodiments discussed is that the drainage of the skylight flange is done internally underneath the exterior surface of the roof rather than externally onto the exterior surface of the roof, at least initially. At lower levels, below the collector trough, the collector trough drainpipe may, if desired, emerge through the lower roof surface or through a soffit wall or the like for connection to a downpipe or spill into an eavestrough, to take two examples. Drainage could also remain internal, for example to a cistern. This internal drainage feature enables the skylight structure as a whole to be constructed simply and economically, and with quite adequate drainage without undue risk of leaks.

As will be apparent to those skilled in the art in the light of the foregoing disclosure, alterations and modifications are possible in the practice of this invention without departing from the spirit or scope thereof. Accordingly, the scope of the invention is to be construed in accordance with the substance defined by the following claims.

What is claimed is:

1. A skylight, for mounting on a roof comprising:
(a) a frame for mounting on the roof;
(b) a flange fixed to and extending outwardly from the base of said frame;
(c) a flange trough in the vicinity of the outer edge of the flange;
(d) at least one outlet in the flange trough;
(e) a collector trough for roof-embedded positioning beneath the outlet; and
(f) a drain for the collector trough, draining same internally rather than onto the outer surface of the roof; each of the elements (b) through (f) being positioned beneath the outer surface of the roof when the skylight is mounted on the roof.

2. A skylight having a window support frame, a flange fixed to and extending outwardly around the base of said frame, a first trough formed in and circumscribing said flange, with at least one outlet in said first trough, characterized by a second trough for roof-embedded positioning beneath said outlet, said second trough having an outlet positioned beneath the outer surface of the roof; the flange, troughs and outlets being positioned beneath the outer surface of the roof when the skylight is mounted on the roof.

3. A skylight for mounting on a roof, comprising in combination
(a) a window support frame;
(b) a flange fixed to, extending outwardly from, and surrounding the window frame and located beneath the roof when the skylight is mounted thereon;
(c) a flange trough formed in the flange extending generally parallel to and in the vicinity of the outer edges of the flange, for receiving and draining away water impinging upon the skylight;

(d) an outlet in the flange trough in the vicinity of its lowermost edge when the skylight is mounted on a sloping roof;

(e) a collector trough for location beneath the flange trough outlet for collecting water draining from the flange trough outlet; and (f) an outlet and associated drain for the collector trough, draining the trough initially internally.

4. A skylight as defined in claim 3, wherein the lowermost flange trough section when the skylight is mounted has a pair of outlets one at each extremity of the flange trough section, and the collector trough when mounted is located underneath both such outlets.

5. A skylight as defined in claim 3 or 4, wherein the collector trough drain is located when mounted so as to drain into an eavestrough of the house.

6. A skylight as defined in claim 3 or 4, wherein at least the upper portion of the collector trough drain when mounted is located beneath or within the roof.

* * * * *